US012006725B1

(12) United States Patent
Licourt

(10) Patent No.: US 12,006,725 B1
(45) Date of Patent: Jun. 11, 2024

(54) WADING POOL WITH HOSE CONNECTION

(71) Applicant: John Licourt, Naples, FL (US)

(72) Inventor: John Licourt, Naples, FL (US)

( * ) Notice: Subject to any disclaimer, the term of this patent is extended or adjusted under 35 U.S.C. 154(b) by 0 days.

(21) Appl. No.: 17/966,008

(22) Filed: Oct. 14, 2022

(51) Int. Cl.
*E04H 4/12* (2006.01)
*E04H 4/00* (2006.01)
*E04H 4/14* (2006.01)

(52) U.S. Cl.
CPC ..... *E04H 4/12* (2013.01); *E04H 4/0037* (2013.01); *E04H 4/14* (2013.01)

(58) Field of Classification Search
CPC ..... E04H 4/12; E04H 4/0037; E04H 4/14
See application file for complete search history.

(56) References Cited

U.S. PATENT DOCUMENTS 2,838,768 A * 6/1958 Fischett ..... A47K 1/14 297/DIG. 8
4,174,808 A * 11/1979 Latin ..... B05B 17/08 239/23
5,016,296 A * 5/1991 Beaumont ..... E04H 4/14 4/496
5,135,440 A * 8/1992 Smollar ..... E04H 4/0025 472/134
6,192,528 B1 * 2/2001 Martinez ..... E04H 4/1236 4/507
6,209,150 B1 4/2001 Hsu et al.
8,627,519 B2 1/2014 Jacobs
2017/0314280 A1 * 11/2017 Velet ..... E04H 4/12
2021/0054640 A1 * 2/2021 Moore ..... E04H 4/14

OTHER PUBLICATIONS

Fimco Industries: Drain Cap and Tether dated Mar. 5, 2020 printed Jan. 8, 2024 (Year: 2020).*

* cited by examiner

*Primary Examiner* — Christine J Skubinna
(74) *Attorney, Agent, or Firm* — Sanchelima & Associates, P.A.; Christian Sanchelima; Jesus Sanchelima

(57) ABSTRACT

A wading pool with hose connection including a pool assembly and a hose bib assembly. The pool assembly includes a pool. The pool is a wading pool. A lateral side of the pool has an opening. The hose bib assembly includes a hose bib and a lid. The hose bib is inserted through said opening. The hose bib is attached to the wading pool. The hose bib is suitable to receive an end of a hose to fill the wading pool. The lid can close an end of the hose bib to prevent water from flowing out of said pool. The lid may be removed from the hose bib to allow flow of water into or out of the pool.

1 Claim, 3 Drawing Sheets

WADING POOL WITH HOSE CONNECTION

BACKGROUND OF THE INVENTION

1. Field of the Invention

The present invention relates to a wading pool with hose connection and, more particularly, to a wading pool with hose connection that allows to drain or fill a wading pool connecting a hose to the pool.

2. Description of the Related Art

Several designs for wading pools have been designed in the past. None of them, however, include a hose bib built in the pool.

Applicant believes that a related reference corresponds to U.S. Pat. No. 6,209,150 issued for a pool having a drain plug. Applicant believes that another related reference corresponds to U.S. Pat. No. 8,627,519 issued for a drain system for a wading pool. None of these references, however, teach of a wading pool having a hose bib coupling for removably attaching a garden hose for filling the pool.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a wading pool with hose connection that includes a hose bib, where the hose bib is suitable for attaching a hose therein.

It is another object of this invention to provide a wading pool with a hose connection that includes a hose bib where the hose bib can be used to drain the pool.

It is still another object of the present invention to provide a wading pool with hose connection that includes a bib cover to seal the hose bib.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
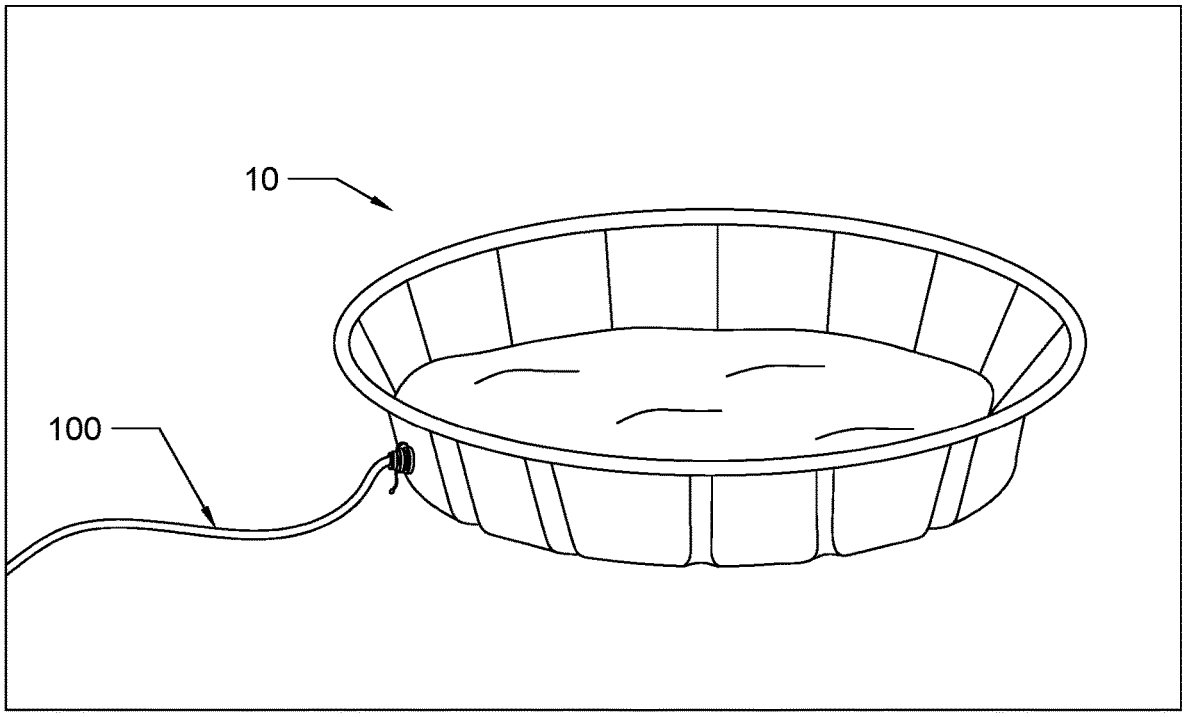
FIG. 1 represents an isometric operational view of the present invention 10 being filled with water by attaching a hose 100 thereto.
Figure 2:
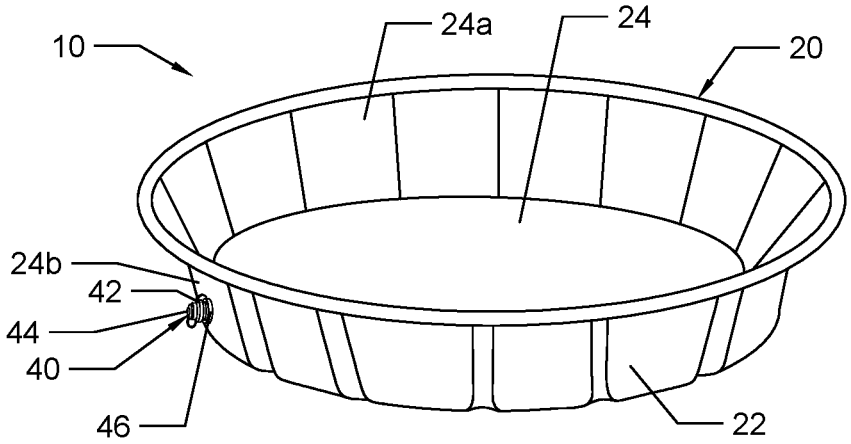
FIG. 2 shows an isometric view of the present invention 10. The present invention 10 includes a pool assembly 20 and a hose bib assembly 40.

Referring now to the drawings, where the present invention is generally referred to with numeral 10, it can be observed that it basically includes a pool assembly 20 and a hose bib assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The pool assembly 20 may include a pool 22. The pool 22 may be a wading pool. The pool 22 may have a lateral interior side 24*a*, a lateral exterior side 24*b* and a bottom wall 24. The pool 22 may have a tapered cylinder shape. It also may be suitable for the pool 22 to have a cuboid shape, a triangular shape, or any other suitable shape. The diameter of the bottommost end of the pool 22 may be smaller than the diameter of the uppermost end of the pool 22. The pool 22 may be hollow. The pool 22 may be suitable to store water therein. The pool 22 may be made of plastic. It also may be suitable for the pool 22 to be made of metal, concrete, or any other suitable material. The lateral exterior side 24*b* may have embossed patterns radially extending along the exterior surface of the pool 22. It also may be suitable for the exterior side 24*b* to be plain. The lateral interior side 24*a* may have embossed patterns radially extending along the interior surface of the pool 22. The bottom wall 24 may have a circular shape. It also may be suitable for the bottom wall 24 to have a rectangular shape, a triangular shape, or any other suitable shape. The bottom wall 24 may be planar.

The pool 22 may have an opening. The opening of the pool 22 may transversally go through from the lateral exterior side 24*b* to the lateral interior side 24*a*. The opening of the pool 22 may have a circular shape. It also may be suitable for the opening of the pool 22 to have a rectangular shape, a triangular shape, or any other suitable shape. The opening of the pool 22 may be suitable to receive the hose bib assembly 40. It may be suitable for the opening of the pool 22 to use sealant to fix the hose bib assembly 40 to the opening of the pool 22.

Figure 3:
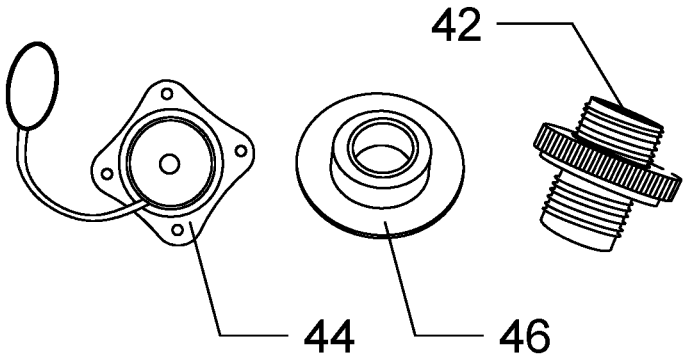
FIG. 3 illustrates an exploded view of the hose bib assembly 40.

The hose bib assembly 40 may include a hose bib 42, a sealing element 46 and a lid 44. The hose bib 42 may be made of polyvinyl chloride. It also may be suitable for the hose bib 42 to be made of copper, steel, or any other suitable material. The hose bib 42 may substantially have a cylindrical shape. It also may be suitable for the hose bib 42 to have a rectangular shape, or any other suitable shape. The hose bib 42 may be hollow. The hose bib may allow fluid communication from the exterior of the pool 22 to the interior of the pool. The hose bib 42 may be suitable to receive a hose 100 therethrough. As best illustrated in FIG. 3 the hose bib 42 may have a distal end, a proximal end, and a lower portion. The distal end and the proximal end of the hose bib 42 may be threaded. The proximal end of the hose bib 42 may be threaded in the aforementioned opening of the pool 22 to secure the hose bib assembly 40 in the pool 22. Indentations may radially extend along the lateral side of the central portion of the threaded element. The indentations of the central portion of the hose bib 42 may help in removing or threading the central portion of the hose bib 42 into the opening of the pool 22. The central portion of the hose bib 42 may be larger in diameter than the proximal end and the distal end of the hose bib 42.

Figure 4:
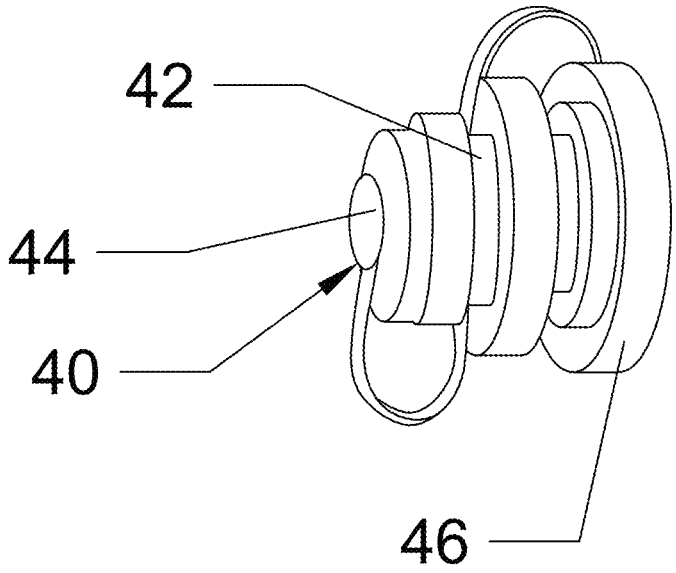
FIG. 4 depicts an isometric view of the present invention 10 in a closed configuration.
Figure 5:
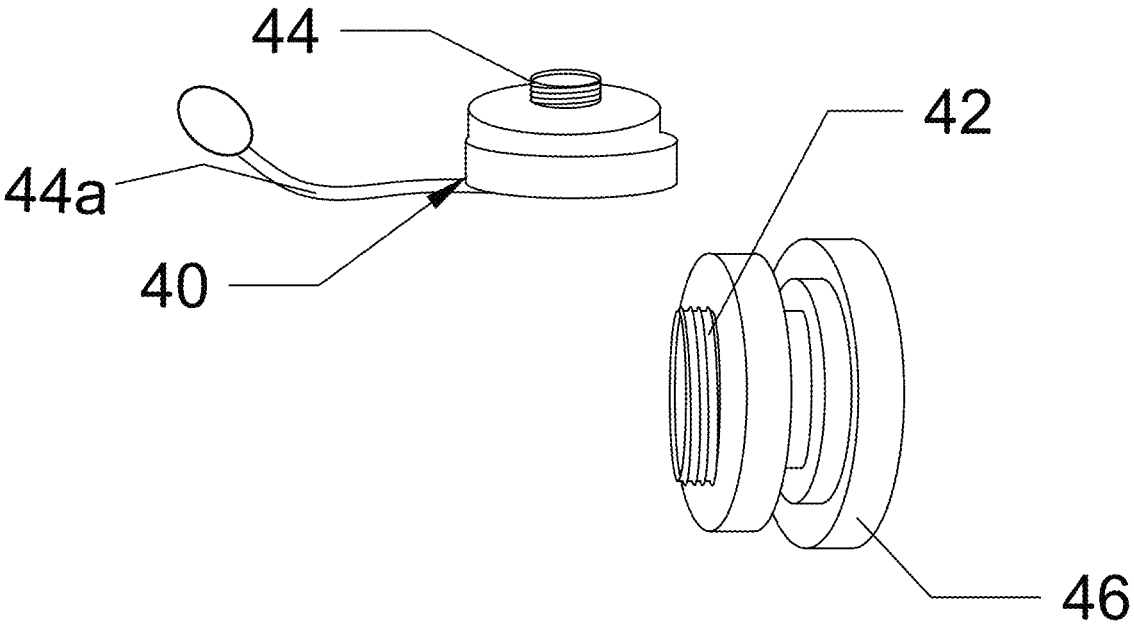
FIG. 5 is a representation of the hose bib assembly 40 in an open configuration.

As best illustrated in FIG. 4 the sealing element 46 may be coupled to the proximal end of the hose bib 42. The sealing element 46 may have a cylindrical shape. It also may be suitable for the sealing element 46 to have a rectangular shape, or any other suitable shape. The sealing element 46 may be made of rubber. The sealing element 46 may have a proximal end and a central portion. The central portion of the sealing element 46 may be greater in diameter than the proximal end of the sealing element 46. In a preferred embodiment the proximal end of the hose bib 42 may be inserted into the pool 42 and into the sealing element 46. The sealing element 46 may enclose the hose bib 42. The sealing element 46 may help in preventing water to leak from the inside to the outside of the pool 42 through the edges of the opening of the pool 22.

The lid 44 may have a proximal end, a distal end, and a central portion. The central portion of the lid 44 may substantially have a rectangular shape. It also may be suitable for the central portion of the lid 44 to have a circular shape, a triangular shape, or any other suitable shape. The proximal end of the lid 44 may have a cylindrical shape. The proximal end of the lid 44 may be suitable to be threaded and tightly enclose the distal end of the hose bib 42. The lid 44 may be used to prevent water flow through the hose bib 42. The lid 44 may have a securing element 44*a*. The securing element 44*a* may connect the distal end of the hose bib 42 with a distal end of the lid 44. As best illustrated in FIG. 4A the securing element may prevent lid 44 to separate from the hose bib 42 when removed from the hose bib 42. When the lid 44 is removed from the distal end of the hose bib 42, the hose bib assembly 40 may be in an open configuration. In the open configuration water may flow into the pool 22 by means of a hose. When the lid 44 is covering the distal end of the hose bib the hose bib assembly 40 may be in a closed configuration. In the closed configuration water may not flow out of the pool 42. The sealing element 46 may also prevent flowback of water when the hose bib assembly is being filled in an open configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wading pool with hose connection, consisting of:

a pool assembly, wherein said pool assembly includes a pool, wherein said pool is a wading pool, said pool has an opening, said opening transversely goes through one of the lateral sides of said wading pool; and a hose bib assembly wherein said hose bib assembly includes a sealing element, a hose bib and a lid, said hose bib is hollow, said hose bib is tubular, said hose bib has a proximal end, a central portion and a distal end, wherein said proximal end of said hose bib is inserted in said opening of said pool to fix said hose bib in said pool, said sealing element is coupled to said proximal end of said hose bib to prevent leaking of water through said opening, said distal end protrudes out of said pool, said distal end and said proximal end are threaded, said central portion has indentations, said distal end of said hose bib receives an end of a hose to fill said wading pool, said lid is configured to close said hose bib to prevent water to flow out of said pool, said lid is detachable coupled to said distal end of said hose bib to close said hose bib, said lid includes a securing element, said securing element is configured to prevent separation of said lid from the hose bib assembly.

* * * * *